US005146633A

United States Patent [19]

Kim et al.

[11] Patent Number: 5,146,633

[45] Date of Patent: Sep. 15, 1992

[54] THERAPEUTIC, PORTABLE BED PROVIDED WITH A WATER HEATING SYSTEM

[76] Inventors: Yong Hak Kim; Soon Ja Kim, both of 330 S. Parrish St., Baltimore, Md. 21223

[21] Appl. No.: 787,229

[22] Filed: Nov. 4, 1991

[51] Int. Cl.[5] ..... A47C 21/04

[52] U.S. Cl. ..... 5/421; 5/284; 5/448

[58] Field of Search ..... 5/421, 422, 284, 448, 5/58.1, 400

[56] References Cited

U.S. PATENT DOCUMENTS

| | | | |
|---|---|---|---|
| 17,102 | 4/1857 | Lefebure . | |
| 333,820 | 1/1886 | Bowman | 5/284 |
| 385,865 | 7/1888 | Lewis | 5/422 |
| 665,243 | 1/1901 | Luria | 5/422 |
| 697,279 | 4/1902 | Schmied | 5/421 |
| 825,763 | 7/1906 | Schaefer . | |
| 1,121,277 | 12/1914 | Mitchell . | |
| 1,212,476 | 1/1917 | Hall | 5/422 |
| 1,817,277 | 8/1931 | Uhlig . | |
| 4,114,620 | 9/1978 | Moore et al. | 128/254 |
| 4,149,541 | 4/1979 | Gammons et al. | 128/400 |
| 4,218,791 | 8/1980 | Itoku | 5/284 |
| 4,561,441 | 12/1985 | Kolodziej | 128/403 |
| 4,663,516 | 5/1987 | Blum | 5/421 |
| 4,884,304 | 12/1989 | Elkins | 5/421 |

*Primary Examiner*—Renee S. Luebke
*Assistant Examiner*—F. Saether
*Attorney, Agent, or Firm*—Birch, Stewart, Kolasch & Birch

[57] ABSTRACT

A therapeutic, portable bed includes an electric water heating system attached to and disposed within a base member of the bed, a hollow headboard which functions as a water tank, a serpentine configured water pipe extending through a concrete plate of the base member, and a cotton pad member containing mugwort herb, disposed on a laminated paper cover on the concrete plate, whereby the bed can be easily moved and a vapor from the cotton pad can warm and treat the human body lying on the bed.

5 Claims, 1 Drawing Sheet

THERAPEUTIC, PORTABLE BED PROVIDED WITH A WATER HEATING SYSTEM

BACKGROUND OF THE INVENTION

1. Field of the Invention

The present invention relates to a therapeutic portable bed provided with a heating system and more particularly, to a portable water heating bed including a base bed member, a serpentine-configured water pipe built in the base bed member, and a water heater, whereby the portable water heating bed can heat a person lying on a pad on the bed by circulating hot water in the water pipe through the water heater attached to the base bed member.

2. Description of the Prior Art

Various types of water heating beds are well known in the art. Such prior art water heating bed includes a separate water heating system and a fixed base bed communicated to the water heating system through a water pipe as shown in U.S. Pat. No. 17,102 to Lefebure, U.S. Pat. No. 825,763 to Schaefer, U.S. Pat. No. 1,121,277 to Mitchell, and U.S. Pat. No. 1,817,277 to Uhlig.

Also, various types of water heating pads are well known in the art. Such prior art water heating pad includes a water tube disposed therein and a separate or composite electric heater for heating the water disposed in tube built in the pad as shown in U.S. Pat. No. 4,114,620 to Moore et al, U.S. Pat. No. 4,149,541 to Gammons et al, U.S. Pat. No. 4,561,441 to Kolodziej, and U.S. Pat. No. 4,884,304 to Elkins.

However, such prior art devices suffer from a number of problems such as, for example, (a) it is very difficult to move the bed with the heating system, (b) it is complicated in structure such as a separate water tank, a separate heater, etc., (c) it cannot expect to achieve a treatment effect for the human body, and (d) it is inconvenient to move due to a separate water heater from the bed compared with that of the present invention.

SUMMARY OF THE INVENTION

Accordingly, it is an object of the present invention to provide an improved portable water heating bed for heating a person lying on the bed, which eliminate the above problems encountered a conventional heating bed.

Another object of the present invention is to provide a portable water heating bed including a base bed member, a serpentine-configured water pipe built in the base bed member, a water tank built in a bed headboard, a water heater attached the base bed member, a roller attached to each leg of the bed, and a pad containing mugwort herb or other pharmaceutical ingredients, whereby when a plug of the water heater is connected to a power source, the hot water is easily circulated within the water pipe and a vapor generated from the pad penetrates and treats a desired region of the human body lying on the bed.

A further object of the present invention is to provide a portable water heating bed which is simple in construction, compact for portability, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a portable water heating bed including a bed body with legs and rollers, a serpentine water tube and a water tank built in the bed body and a bed headboard thereof, respectively, a water heater attached to the bed body, a mugwort herb pad disposed on the bed body, whereby the water heating bed can be easily moved by rollers and a vapor generated from the pad heated by the water tube through the water heater warms and treats a human body lying thereon.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
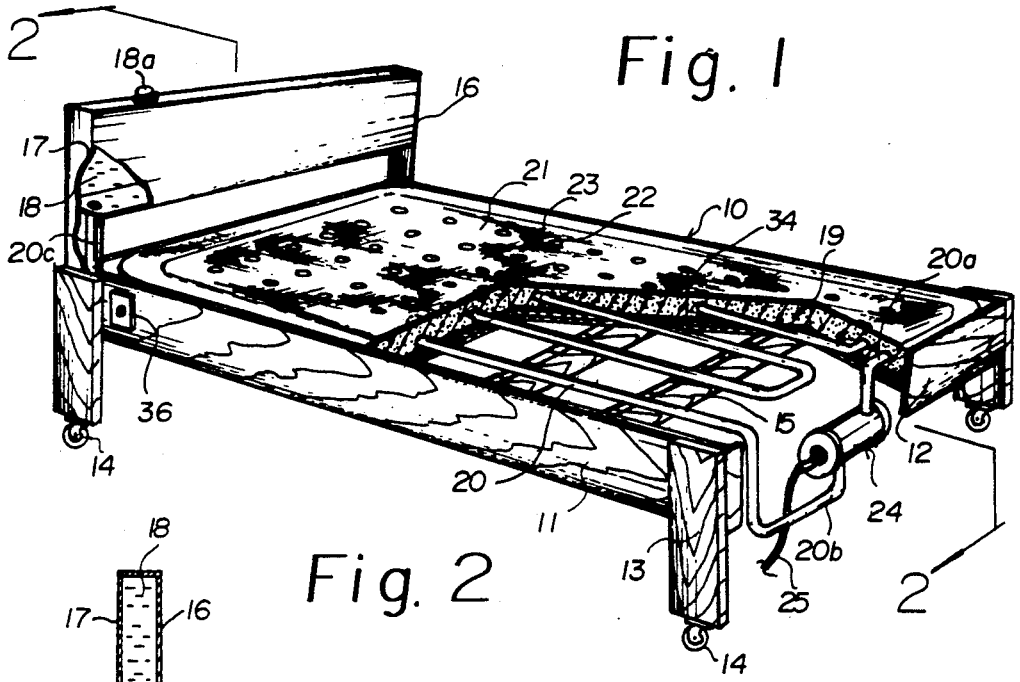
FIG. 1 is a perspective view of the portable water heating bed cut-away portions in order to illustrate the construction of the water heating bed according to the present invention.
Figure 2:
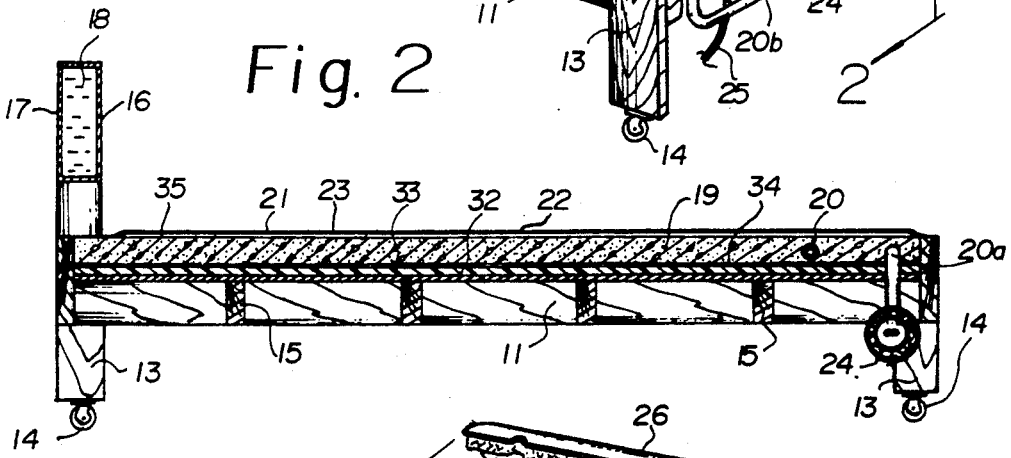
FIG. 2 is a sectional view of FIG. 1, taken along line 2—2.

Referring now in detail to the drawings for the purpose of illustrating preferred embodiments of the present invention, the portable water heating bed as shown in FIGS. 1 and 2, comprises a base bed member 10 including a pair of longitudinal and transverse frames 11 and 12, a plurality of legs 13 with each roller 14, and a plurality of supports 15, a serpentine-configured water pipe 20 extending through the base bed member 10, a water heater 24 attached to the base bed member 10, and a water tank 17 with water 18 built in a bed headboard 16.

As shown in FIG. 2, a wood plate 32 is stacked on the plurality of supports 15 and an insulating plate 33 made of Styrofoam TM is stacked on the wood plate 32. Thereafter, the serpentine-configured water pipe 20 is put on the insulating plate 33 and the serpentine water pipe 20 is bound with a wire net 34. And then a concrete 19 is put on them for burying the water pipe 20 and a floor 35 covered with laminated paper is attached on the concrete 19. As shown in FIGS. 1 and 2, a separate cotton pad 21 adapted to contain mugwort herb (*Artemisian vulgaris*) or other pharmaceutical ingredients and provided with a plurality of apertures 22 covers the floor 35 for vaporizing the ingredients in the pad, whereby upon the heating of the water heater 24, the medicinal ingredients are evaporated to penetrate and treat any desired portion of the human body.

Figure 3:
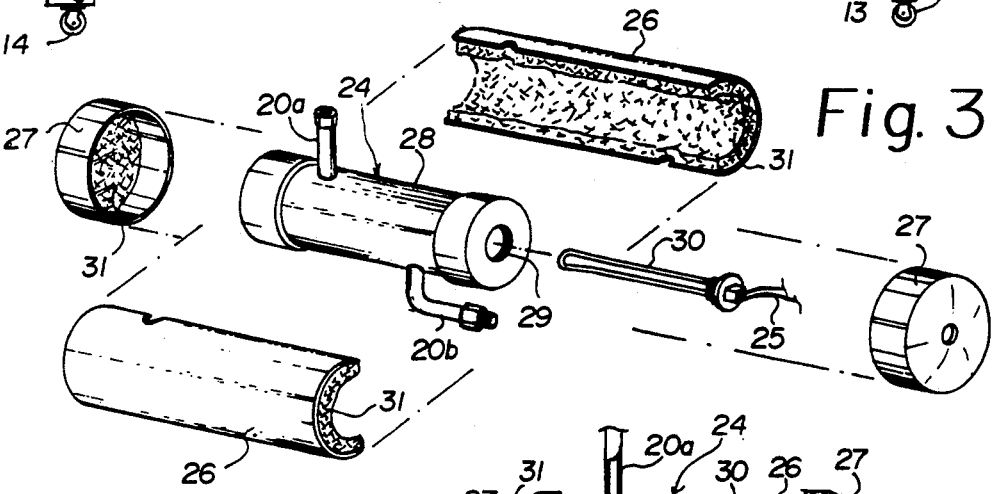
FIG. 3 is a exploded perspective view of a water heater of the water heating ted according to the present invention.
Figure 4:
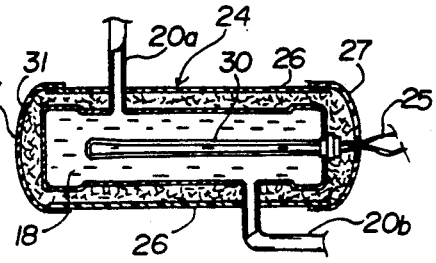
FIG. 4 is a sectional view of the assembled water heater of FIG. 3.

As shown in FIGS. 3 and 4, the water heater 24 includes a cylindrical heater body 28 containing the water 18, an upper water outlet **20*a* and a lower water inlet 20*b*, and a central hole 29 for slidably receiving an electric heater 30 with a pair of electric wires 25 which is connected to an on/off switch 36. The water heater 24 is covered by a pair of semi-body covers 26 and a pair of caps 27 with each insulating material 31**.

According to the present invention, the portable water heating bed operates as follows:

Prior to use, the water tank 17 is filled with water 18 as shown in FIG. 1 and the cotton pad is pre-wetted, when a plug (not shown) is connected to a power source, the pre-wetted pad is heated by the water heater 24 through the serpentine-configured water pipe 20 built in the concrete 19 of the base bed member 10. The vapor evaporating from the pad 21 can then be used to penetrate any desired region of the human body. The heat energy and pressure simultaneously act to treat the effected portion. Also, the portable water bed of the present invention can be easily moved by using the rollers 14 and cannot adversely effect the environment since there is no burning system.

The water heater 24 having the electric heater 30 can warm the water 18 disposed therein and the heated water 18 can flow upward to the upper water outlet 20*a* and then the heated water 18 goes through the serpentine-configured water pipe 21. Accordingly, the heated floor 35 is heated through the heated concrete floor 19. The hot air around the heat emitting floor 35 heats the cotton pad 21. Thus the vapor from the cotton pad 21 warms the human body as well as penetrates and treats any desired region of the human body.

On the other hand, the cooled water 18 disposed in the pipe 20 around the lower water inlet 20*b* goes into the water heater 24 through the lower water inlet 20*b*. Accordingly, the water 18 can circulate in the water pipe 20 by heating the electric heater 30.

Furthermore, the water tank 17 built in the bed headboard 16 is provided with a security valve 18*a* disposed on the top of the water tank 17 so that the water tank 17 is prevented from exploding due to the accumulation of excess temperature or pressure in the water tank 17. Also, the security valve 18*a* can be used as a water supply inlet.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A therapeutic, portable bed provided with a water heating system, comprising:

a base member having a bottom support member, an insulating plate disposed on said bottom support member, a concrete plate and a laminated paper cover disposed in sequence on said insulated plate, a pair of longitudinal frames, and a plurality of transverse frames, said longitudinal frames and said transverse frames defining a bed support for said insulating plate, concrete plate, and laminated cover, a serpentine configured water tube extending through said concrete plate of the base member, a hollow headboard which functions as a water tank, said hollow headboard communicating with said serpentine configured water tube, an electric water heater attached to and disposed within said base member, said electric water heater communicating with said serpentine configured water tube, said electric water heater being provided with a cylindrical heater body adapted to contain water and for slidably receiving the electric water heater therewithin and a water heater cover defining a pair of semi-body covers and a pair of caps for covering the cylindrical heater body therewithin, and a cotton pad member containing mugwort herb, *Artemisian vulgaris*, and disposed on said laminated paper cover, whereby the bed having a water heater system can be easily moved and a vapor from the cotton pad can warm and treat the human body lying on the water heating bed.

2. The therapeutic, portable bed of claim 1, wherein said water tube is buried in said concrete plate with a wire net.

3. The therapeutic, portable bed of claim 1, wherein said hollow headboard is provided with a security valve disposed on the top thereof.

4. The therapeutic, portable bed of claim 3, wherein said security valve uses as a water supply inlet.

5. The therapeutic, portable bed of claim 1, wherein said water heater cover includes an insulating material disposed therein.

* * * * *